US008999076B2

(12) United States Patent
McCormick et al.

(10) Patent No.: US 8,999,076 B2
(45) Date of Patent: Apr. 7, 2015

(54) TRICHROME PASSIVATES FOR TREATING GALVANIZED STEEL

(75) Inventors: David R. McCormick, Clawson, MI (US); Thomas W. Cape, West Bloomfield, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 839 days.

(21) Appl. No.: 12/430,509

(22) Filed: Apr. 27, 2009

(65) Prior Publication Data

US 2009/0266450 A1 Oct. 29, 2009

Related U.S. Application Data

(60) Provisional application No. 61/048,004, filed on Apr. 25, 2008.

(51) Int. Cl.

| | |
|---|---|
| ***C23C 22/30*** | (2006.01) |
| ***C23C 22/36*** | (2006.01) |
| ***C23C 26/00*** | (2006.01) |
| ***C23F 11/12*** | (2006.01) |
| ***C23F 11/14*** | (2006.01) |
| ***C23F 11/173*** | (2006.01) |
| *C23C 22/07* | (2006.01) |

(52) U.S. Cl.

CPC ..... *C23C 26/00* (2013.01); *C23C 22/36* (2013.01); *C23C 22/361* (2013.01); *C23C 2222/10* (2013.01); *C23F 11/12* (2013.01); *C23F 11/141* (2013.01); *C23F 11/173* (2013.01)

(58) Field of Classification Search

CPC .... C23C 2222/10; C23C 20/36; C23C 20/361
USPC ..... 148/247, 258, 264–268, 253; 106/14.12
See application file for complete search history.

(56) References Cited

U.S. PATENT DOCUMENTS

| | | | | |
|---|---|---|---|---|
| 4,668,305 | A | 5/1987 | Dollman et al. | |
| 4,749,418 | A | 6/1988 | Saeki et al. | |
| 5,091,023 | A | 2/1992 | Saeki et al. | |
| 5,395,655 | A | 3/1995 | Kazuyuki et al. | |
| 5,685,922 | A * | 11/1997 | Endou et al. | 148/247 |
| 5,807,442 | A | 9/1998 | Goodreau | |
| 6,287,704 | B1 | 9/2001 | Preikschat et al. | |
| 6,472,352 | B1 | 10/2002 | Hacias | |
| 6,532,784 | B1 | 3/2003 | Dunn et al. | |
| 6,670,315 | B1 | 12/2003 | Marlin et al. | |
| 6,709,619 | B2 | 3/2004 | MacDonald et al. | |
| 6,733,896 | B2 | 5/2004 | Dolan et al. | |
| 6,821,633 | B2 | 11/2004 | Liu et al. | |
| 6,899,770 | B1 | 5/2005 | Goodreau et al. | |
| 6,946,201 | B2 | 9/2005 | Preikschat et al. | |
| 7,314,671 | B1 | 1/2008 | Preikschat et al. | |
| 2002/0007873 | A1 | 1/2002 | McCormick | |
| 2002/0053301 | A1 * | 5/2002 | Matzdorf et al. | 106/14.44 |
| 2003/0207133 | A1 | 11/2003 | Preikschat et al. | |
| 2004/0173289 | A1 | 9/2004 | Kinoshita et al. | |
| 2006/0185769 | A1 * | 8/2006 | Nakayama et al. | 148/247 |
| 2006/0240191 | A1 | 10/2006 | Matzdorf et al. | |
| 2007/0018135 | A1 | 1/2007 | McCormick et al. | |
| 2007/0023104 | A1 * | 2/2007 | Yamamoto et al. | 148/266 |
| 2007/0125451 | A1 | 6/2007 | Smith et al. | |
| 2008/0314479 | A1 | 12/2008 | Cape | |
| 2009/0032057 | A1 | 2/2009 | McCormick et al. | |

FOREIGN PATENT DOCUMENTS

| | | | |
|---|---|---|---|
| EP | 1992718 | A1 | 11/2008 |
| EP | 2014793 | A2 | 1/2009 |
| JP | 20043019 | A | 1/2004 |
| KR | 1020040016456 | A | 2/2004 |
| KR | 1020080000564 | A | 1/2008 |
| WO | 2007055701 | A1 | 5/2007 |

OTHER PUBLICATIONS

PCT International Search Report Dated Dec. 16, 2009—Applicant Henkel AG & Co, Kgaa et al., Application No. PCT/US2009/041815, 15 pages.
Patent Abstract JP3579542.
Supplementary European Search Report for EP application 09734725, dated Feb. 9, 2012.

* cited by examiner

*Primary Examiner* — Lois Zheng
(74) *Attorney, Agent, or Firm* — Mary K. Cameron

(57) ABSTRACT

In one embodiment, the invention provides a composition useful for passivating a metal surface, in particular a zinciferous surface, comprising, preferably consisting essentially of, most preferably consisting of water and:

(A) dissolved phosphate ions;
(B) dissolved trivalent chromium ions;
(C) dissolved anions of at least one complex fluoride of an element selected from the group consisting of Ti, Zr, Hf, Si, Sn, Al, Ge and B; preferably Ti, Si and/or Zr;
(D) an optional component of dissolved free fluoride ions;
(E) organic acid inhibitor, preferably comprising quaternary ammonium compounds; and, optionally
(F) a pH adjusting component; and
optionally organic hydroxyl acids.

28 Claims, No Drawings

TRICHROME PASSIVATES FOR TREATING GALVANIZED STEEL

CROSS-REFERENCE TO RELATED APPLICATIONS

This application claims the benefit of U.S. Provisional application Ser. No. 61/048,004, filed Apr. 25, 2008, which is incorporated herein by reference.

FIELD OF THE INVENTION

This invention relates to treatment of zinc and zinc alloy, hereinafter referred to as zinciferous, metal surfaces to enhance their resistance to corrosion, more particularly to a class of liquid treatment compositions that herein are called "passivators" or "passivating" compositions, solutions, or the like. These liquid treatment compositions, when brought into contact with metal surfaces that are chemically "active", in particular zinciferous surfaces such as those of galvanized steel, react chemically with the metal surfaces, without any need for externally applied electromotive force, to form on the metal surface an adherent layer coating which (i) has very low solubility in water, (ii) normally contains some cations derived from the metal surface and some anions derived from the treatment composition, and (iii) enhances the resistance of the metal surfaces as so treated to corrosion by many normally corrosive aqueous liquid compositions that may later come into contact with the metal surfaces so treated, compared with the same metal surface that has not been treated.

This invention is more particularly related to hexavalent chromium-free, aqueous treatment compositions that form such coatings and that comprise dissolved phosphate anions, at least one of fluorozirconate, fluorotitanate, fluorosilicate, fluoroborate, and fluoroaluminate anions also in solution along with trivalent chromium, and optionally at least one acid inhibitor and/or at least one inorganic metal compound.

BACKGROUND OF THE INVENTION

A variety of aqueous hexavalent chromium containing passivating compositions that also contain phosphate and one of the fluorometallate ions noted above are known in the art, for example as taught in U.S. Pat. Nos. 5,807,442 of Sep. 15, 1998 to Goodreau; U.S. Pat. No. 5,091,023 of Feb. 25, 1992 to Saeki et al.; U.S. Pat. No. 4,749,418 of Jun. 7, 1988 to Saeki et al.; U.S. Pat. No. 4,668,305 of May 26, 1987 to Dollman et al.; all of which, to the extent not inconsistent with any explicit statement herein, are hereby incorporated herein by reference.

With increasing recognition of the environmental and safety impact of hexavalent chromium, attempts have been made to replace all or some of the hexavalent chromium in passivates with trivalent chromium, for example as taught in U.S. Patent Application Publication No. 2004/0173289. However, doing so has resulted in unforeseen challenges. Some conventional trivalent chromium passivating working baths lose stability after ageing due in part to dissolution of metal from the substrates, particularly substrates having zinciferous surfaces, into the bath. Thus, zinc build-up in working baths of trivalent chromium passivates is a significant problem industrially where for example rapid metal coating processes can run in excess of 100 sq ft per minute through baths.

Prior art Cr (VI) passivating compositions used the oxidizing nature of hexavalent chromium to inhibit dissolution of metal from the substrate into the bath, which gave the Cr(VI) working baths adequate stability. In replacing Cr(VI) with Cr(III) in passivating baths, oxidative inhibition of metal dissolution from the substrates was lost and bath instability resulted. Conventional thinking has taught that other oxidizers, such as nitrates and peroxides, replacing Cr (VI) should be added to the Cr (III) passivating compositions so that, when the compositions were made into working baths, the oxidizers would inhibit dissolution of the metal substrate into the bath. This prior art approach had some success, but caused other problems and limitations on additions to the coating compositions. For example, the presence of these replacement oxidizers resulted in production of toxic gases, such as NO and $CO_2$, by reaction of the oxidizers with any organic material, in particular residual organic material used to reduce the Cr(VI) to Cr(III) in the passivating composition. The presence of oxidizers also limited the use of other organic additives that might be beneficial to the extent that the organic additive could be predicted to react with an oxidizer. Thus, there is a need for a means of reducing build-up of Zn in Cr (III) working baths in the absence of Cr (VI), and in the absence of other oxidizers in the bath which react to produce noxious gasses.

Another drawback of conventional Cr (VI)-free, trivalent chromium-containing coatings is that they provide reduced corrosion resistance of the coated metal substrate as compared to similar substrates passivated using Cr (VI)-containing chromium compositions. Conventional Cr (VI)-free, trivalent chromium-containing passivate compositions also require higher amounts of phosphate to stabilize the Cr (III) in the bath, but the presence of the excess phosphate also has drawbacks including reducing corrosion resistance (for example in the neutral salt spray test) and increased staining of coated substrates. Thus, there is a need, particularly in passivating zinciferous surfaces, for a composition and process that provides improved product stability and better corrosion and stain resistance of coated substrates.

SUMMARY OF THE INVENTION

Applicants have developed a trivalent chromium containing passivating composition that provides coated metal substrates with significantly improved salt spray corrosion resistance, stain resistance and/or electrical conductivity performance, as compared to conventional trivalent chromium passivates, does not generate toxic gases during storage and has improved working bath stability.

In attempting to improve corrosion resistance of metal substrates passivated with conventional Cr(III) containing passivating compositions, Applicants incorporated a variety of organic materials thought to be useful as corrosion inhibitors into Cr (VI)-free, trivalent chromium-containing coatings on zinciferous surfaces. It was found that corrosion resistance of the coated substrates did not improve with the addition of these materials and that noxious gasses resulted. An unexpected result was observed in working baths comprising certain of the organic materials, namely, that the amount of zinc metal dissolved from substrates having zinciferous surfaces was reduced as was the consumption of acid in the working bath, while still generating a passivating coating. The surprising reduction in the amount of zinc dissolving into the working bath also allowed removal of the oxidizers from the formulation thereby reducing the risk of producing toxic gases.

Additional investigations were made in seeking to improve corrosion resistance of Cr (VI)-free, trivalent chromium-containing passivate coatings. Conventional thinking was that, in the absence of oxidizer, high levels of fluoride combined with Cr (III) and phosphate were required to coat zinciferous surfaces. A drawback of these formulations was that high levels of fluoride were damaging to stainless steel coating equipment. Eliminating fluoride resulted in reduced corrosion resistance, while reduced fluoride and increased phosphate resulted in staining of the passivated substrates when contacted with water. Through extensive experimentation, Applicants found that reducing the ratio of phosphate anions to Cr(III) cations and adding fluorometallate anions resulted in greatly improved corrosion resistance of substrates coated with the compositions. The compositions according to the invention approximately double the salt spray resistance of zinciferous surfaces coated with the compositions. The resistivity of the coated substrates was also beneficially lowered, as compared to conventional trivalent chromium coatings on the same substrates, making the coated substrates available for use in electronics fields.

Various embodiments of the invention include working compositions for direct use in treating metals, make-up concentrates from which such working compositions can be prepared by dilution with water, replenisher concentrates suitable for maintaining optimum performance of working compositions according to the invention, processes for treating metals with a composition according to the invention, and extended processes including additional steps that are conventional per se, such as cleaning, rinsing, and subsequent painting or some similar overcoating process that puts into place an organic binder-containing protective coating over the metal surface treated according to one embodiment of the invention. Articles of manufacture including surfaces treated according to a process of the invention are also within the scope of the invention.

Except in the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counter-ions to produce electrical neutrality for the composition as a whole (any counter-ions thus implicitly specified should preferably be selected from among other constituents explicitly specified in ionic form, to the extent possible; otherwise such counter-ions may be freely selected, except for avoiding counter-ions that act adversely to the objects of the invention); the first definition of an acronym or other abbreviation applies to all subsequent uses herein of the same abbreviation and applies mutatis mutandis to normal grammatical variations of the initially defined abbreviation; the term "paint" includes all like materials that may be designated by more specialized terms such as lacquer, enamel, varnish, shellac, topcoat, and the like; and the term "mole" and its variations may be applied to elemental, ionic, and any other chemical species defined by number and type of atoms present, as well as to compounds with well defined molecules.

DETAILED DESCRIPTION OF A PREFERRED EMBODIMENT

In one embodiment, the invention provides a composition useful for passivating a metal surface, in particular a zinciferous surface, comprising, preferably consisting essentially of, most preferably consisting of water and:

(A) a component of dissolved phosphate ions;
(B) a component of dissolved trivalent chromium ions;
(C) a component of dissolved anions of at least one complex fluoride of an element selected from the group consisting of Ti, Zr, Hf, Si, Sn, Al, Ge and B; preferably Ti, Si and/or Zr;
(D) an optional component of dissolved free fluoride ions;
(E) a component of organic acid inhibitor, preferably comprising quaternary ammonium compounds;

and, optionally but not necessarily preferably, one or more of the following components:

(F) a pH adjusting component;
(G) a component of dissolved, stably suspended, or both dissolved and stably suspended organic substances that reduce, and/or organic substances produced by reducing, hexavalent chromium previously present in the composition to trivalent chromium;
(H) at least one dissolved inorganic metal compound; and
(I) at least one further additive selected from the group consisting of a sequestrant, a wetting agent, and a defoamer.

The compositions of the invention have been developed as hexavalent chrome-free passivates that desirably perform as well as, and in some aspects better than, hexavalent chrome containing passivates of the prior art. Although not preferred, formulations according to the invention can be made including hexavalent chromium. Compositions according to the invention desirably contain less than 0.04, 0.02, 0.01, 0.001, 0.0001, 0.00001, 0.000001 percent by weight of hexavalent chromium, most preferably essentially no hexavalent chromium. The amount of hexavalent chromium present in the compositions of the invention is desirably minimized and preferably only trace amounts are present, most preferably no hexavalent chromium is present.

Oxidants, such as peroxide and nitrates were identified as undesirable in the compositions according to the invention and like hexavalent chromium, their presence is minimized in products according to the invention. The compositions have been developed in the absence of nitrates and peroxides. It is particularly preferred that the compositions according to the invention contain less than 0.04, 0.02, 0.01, 0.001, 0.0001, 0.00001, 0.000001 percent by weight of nitrates or peroxides, most preferably essentially no nitrates or peroxides.

The dissolved phosphate ions that comprise component (A) may be obtained from a variety of sources as known in the art. Normally much of the phosphate content will be supplied by phosphoric acid added to the composition, and the stoichiometric equivalent as phosphate ions of all undissociated phosphoric acid and all its anionic ionization products in solution, along with the stoichiometric equivalent as phosphate ions of any dihydrogen phosphate, monohydrogen phosphate, or completely neutralized phosphate ions added to the composition in salt form, are to be understood as forming part of phosphate ions, irrespective of the actual degree of ionization and/or reaction to produce some other chemical species that exists in the composition. If any metaphosphoric acid, other condensed phosphoric acids, or salts of any of these acids are present in the compositions, their stoichiometric equivalent as phosphate is also considered part of the phosphate component. Generally, however, it is preferred, at least partly for reasons of economy, to utilize orthophosphoric acid and its salts as the initial source for the phosphate component.

In a working passivating aqueous liquid composition according to the invention, the concentration of phosphate ions and/or their stoichiometric equivalents as noted above preferably is at least, with increasing preference in the order given, 2.0, 3.0, 4.0, 5.0, 6.0, 7.0, 9.0, 10.0, 12.0, 13.0, 14.0, 15.0, 16.0 or 17.0 grams per liter (hereinafter usually abbreviated as "g/L") of total composition and independently preferably is not more than, with increasing preference in the order given, 400, 200, 100, 90, 80, 75, 70, 60, 50, 45, 40 or 34 g/L.

The dissolved trivalent chromium ions that comprise component (B) can be added directly to water in the course of preparing a composition according to the invention by use of salts of trivalent chromium cations, or, preferably at least for economic reasons, trivalent chromium component (B) may be obtained by adding hexavalent chromium during the course of preparing a composition according to the invention and then converting the hexavalent chromium into trivalent chromium by the addition of a reductant such as tannic acid, starch, alcohol, hydrazine, sucrose, and the like. Alcohols, such as sorbitol, are most preferred as the reductant, because it is more likely to result in a concentrated solution having little or no residual component (G). Suitable amounts of reductant depend on the amount of reduction achieved by their use and will be readily calculable by those of skill in the art. Preferably, any reductant used to convert some of the initial hexavalent chromium content to trivalent chromium produces from itself when oxidized only water and gaseous products such as carbon dioxide, which escape from the compositions. However, some other product or products formed by oxidation of the reductant may remain in a composition according to the invention as optional component (G).

In a working passivating aqueous liquid composition according to the invention, the concentration of trivalent chromium ions preferably is at least, with increasing preference in the order given, 1.0, 2.0, 3.0, 4.0, 5.0, 6.0, 7.0, 9.0, 10.0, 12.0, 13.0, 14.0, 15.0, 16.0 or 17.0 grams per liter (hereinafter usually abbreviated as "g/L") of total composition and independently preferably is not more than, with increasing preference in the order given, 75, 70, 60, 50, 45, 40, 35, 30, 25, 20 g/L.

Furthermore, independently of their actual concentrations, the concentrations of phosphate ions and trivalent chromium ions preferably are such that the ratio between them, in working compositions and concentrated solutions used to prepare working concentrations, is at least, with increasing preferance in the order given, 0.10:1.0, 0.15:1.0, 0.25:1.0, 0.35:1.0, 0.45:1.0, 0.50:1.0, 0.55:1.0, 0.60:1.0, 0.65:1.0, 0.75:1.0 or 0.90:1.0 and independently preferably is not more than, with increasing preference in the order given, 7.5:1.0, 5:1.0, 4:1.0, 3.5:1.0, 3.2:1.0, 2.5:1.0, 2.0:1.0 1.75:1.0 or 1.5:1.0. Maintaining the level of phosphate and chromium within these ratios helps to maintain the coatings on the metal surfaces.

Component (C), dissolved anions of at least one complex fluoride of an element selected from the group consisting of Ti, Zr, Hf, Si, Sn, Al, Ge and B (preferably, Ti, Zr and/or Si; most preferably, Si) can be added as acids or salts or formed in situ by dissolution of the appropriate oxides in the presence of sufficient HF. The complex fluoride should be water-soluble or water-dispersible and preferably comprises an anion comprising at least 4 fluorine atoms and at least one atom of an element selected from the group consisting of Ti, Zr, Hf, Si, Sn, Al, Ge or B. The complex fluorides (sometimes referred to by workers in the field as "fluorometallates") preferably are substances with molecules having the following general empirical formula (I):

$$H_pT_qF_rO_s \quad (I)$$

wherein each of p, q, r, and s represents a non-negative integer; T represents a chemical atomic symbol selected from the group consisting of Ti, Zr, Hf, Si, Sn, Al, Ge, and B; r is at least 4; q is at least 1 and preferably is not more than, with increasing preference in the order given, 3, 2, or 1; unless T represents B, (r+s) is at least 6; s preferably is not more than, with increasing preference in the order given, 2, 1, or 0; and (unless T represents Al) p is preferably not more than (2+s), with all of these preferences being preferred independently of one another. One or more of the H atoms may be replaced by suitable cations such as ammonium, metal, or alkali metal cations (e.g., the complex fluoride may be in the form of a salt, provided such salt is water-soluble or water-dispersible).

The acids are usually preferred for economy and because a net acidity of the compositions is preferable as considered further below, and the entire stoichiometric equivalent as any of the above recited fluorometallate ions in any source material as dissolved in a composition according to the invention or a precursor composition for it is to be considered as part of the fluorometallate component, irrespective of the actual degree of ionization that may occur. Independently of their chemical nature, the total concentration of the fluorometallate anions dissolved in a working treatment composition according to the invention preferably is at least, with increasing preference in the order given, 0.5, 1.0, 2.0, 2.5, 3.0, 4.0, 5.0, 6.0, 7.5, 8.5, 10.0, 12.0, or 13.0 g/L and independently, primarily for reasons of economy, preferably is not more than, with increasing preference in the order given, 60, 50, 45, 40, 38, 37.5, 35.0, 32.5 30.0, 28.0, 27.0, 26.0, 25.0, 24.0, or 23.0 g/L.

Illustrative examples of suitable complex fluorides include, but are not limited to, $H_2TiF_6$, $H_2ZrF_6$, $H_2HfF_6$, $H_2SiF_6$ (which is especially preferred), $H_2GeF_6$, $H_2SnF_6$, $F_3AlF_6$, $ZnSiF_6$, and $HBF_4$ and salts (fully as well as partially neutralized) and mixtures thereof Examples of suitable complex fluoride salts include $NH_4MF_6$, $SrMF_6$, $MgMF_6$, $Na_2MF_6$ and $Li_2MF_6$, where "M" is selected from the group consisting of Ti, Zr, Hf. Si, Sn, Al, and Ge.

The optional dissolved free fluoride ions of component (D) may be supplied from any suitable source, such as hydrofluoric acid and water-soluble neutral and acid salts of hydrofluoric acid. Hydrofluoric acid is normally preferred, at least partially for reasons of economy, and the total concentration of component (D), if present, measured as its stoichiometric equivalent as HF whether or not actually present in that chemical structure, in a working aqueous solution according to the invention preferably is at least, with increasing preference in the order given, 0.1, 0.3, 0.5, 0.7, 0.9, 1.1, 1.3, 1.5, 1.7, 1.9, 2.1, 2.3, 2.5, 2.7, 2.9, 3.1, or 3.3 g/L and independently preferably is not more than, with increasing preference in the order given, 25, 20, 15, 10, 8, 7.0, 6.0, 5.0, 4.5, 4.0, or 3.5 g/L. Generally, higher concentrations of component (D) favor the stability of concentrated aqueous solutions according to the invention, but too high a concentration of component (D) can lead to too vigorous an attack on the metal being treated by a working composition that is made by diluting a concentrated aqueous solution according to the invention that has too much free fluoride. If excessively vigorous attack on the metal surface occurs, the corrosion protective value of the coating layer formed on the metal is diminished, and in extreme cases, no adherent coating layer at all may result.

In one embodiment, no HF, as such, is added to the compositions of the invention. In this embodiment it is preferred that the amount of HF be kept to a minimum recognizing as those of skill in the art would that certain raw materials contain traces of HF or generate HF when dissolved in an aqueous acidic composition.

The component of organic acid inhibitor (E) typically comprises a composition including a quaternary ammonium compound of the general formula $(R)_4N^+X^-$wherein each R is independently selected from hydrogen; alkyl groups that may be linear or branched; cycloalkyl, aryl and heterocyclic groups, that may be substituted or unsubstituted; where desirably no more than two of the R groups are hydrogen; and X represents an anion such as, for example, a halide. Examples of such compounds include N-alkyl, N-cycloalkyl and N-alkylaryl substituted and unsubstituted pyridinium halides such as N-cyclohexylpyridinium bromide, N-octylpyridinium bromide, N-dodecylpyridinium bromide, N,N-didodecyldipyridinium dibromide, N-tetradecylpyridinium bromide, N-benzylquinolinium bromide, 1-benzylquinolinium bromide, N-laurylpyridinium chloride, N-dodecylbenzylpyridinium chloride, N-dodecylquinolinium bromide, N-(1-methylnapthyl)quinolinium chloride, 1-benzylquinolinium chloride, N-benzylquinolinium chloride and the like. Other quaternary ammonium compounds include monochloromethylated and bischloromethylated pyridinium halides, ethoxylated and propoxylated quaternary ammonium compounds, polyalkyleneamine and polyalkylenepolyamine quaternized polymers, in particular, polyalkyleneamine and polyalkylenpolyamine arylhalide quaternized polymers, optionally with glyoxal, such as polyethylenepolyamine benzyl bromide, polyethylenepolyamine benzyl chloride, polymethylenepolyamine benzyl bromide, polymethylenepolyamine benzyl chloride. Additional inhibitors considered suitable include didodecyldimethylammonium chloride, hexadecylethyldimethylammonium chloride, 2-hydroxy-3-(2-undecylamidoethylamino)-propane-1-triethylammonium hydroxide, 2-hydroxy-3-(2-heptadecylamidoethylamino) -propane-1-triethyl ammonium hydroxide, 2-hydroxy-3-(2-heptadecylamidoethylamino) -propane-1-triethyl ammonium hydroxide, 2-mercaptobenzimidazole and the like. Desirably the acid inhibitor component of the present invention comprises an aromatic quaternary ammonium compound and, in particular, an aryl substituted quinolinium halide, and, in particular 1-benzylquinolinium halide.

In a working passivating aqueous liquid composition according to the invention, the concentration of organic acid inhibitor is selected to provide reduced dissolution of the metal substrate into the working bath without unduly interfering with etching of the substrate that is necessary to deposit the passivating coating. In a working bath, the concentration of organic acid inhibitor, measured as quaternary ammonium compounds of the general formula $(R)_4N^+X^-$, as described above, preferably is at least, with increasing preference in the order given, 0.001, 0.0025, 0.005, 0.010, 0.015, 0.020, 0.025, 0.030, 0.035, 0.040, 0.045, 0.050, 0.07, 0.08, 0.09, or 0.10 grams per liter (hereinafter usually abbreviated as "g/L") of total composition and independently preferably is not more than, with increasing preference in the order given, 2.0, 1.75, 1.50, 1.25, 1.0, 0.75, 0.50, 0.45, 0.40, 0.375, 0.30, 0.25, 0.20, or 0.15 g/L.

Generally, the effectiveness of the passivate composition in imparting corrosion resistance to a metal surface will be influenced by the pH of the composition. One or more pH adjusting components (F) may be used in compositions according to the invention. The pH of the working treatment formulation according to the invention should be from 0.5 to 5.0, more preferably 1.0 to 4.5, and most preferably from 1.5 to 2.5. The pH can be adjusted using a pH adjusting component such as an acid, such as phosphoric acid or a carboxylic acid, such as acetic acid, citric acid, and/or glycolic acid, or a base such as sodium hydroxide, potassium hydroxide, sodium carbonate, or ammonium hydroxide. In at least one embodiment, malic acid and the like, such as D- or L-malic acid, and particularly DL-malic acid, has been found to be particularly effective. Generally, acids are added to the composition to lower pH and optimize its effectiveness. Although both organic, such as hydroxyorganic acids, as well as inorganic acids can be used, generally it will be preferred to use a mineral acid such as a phosphorus-containing acid (e.g., phosphoric acid). The phosphate ions of component (A) may be derived, in whole or in part from this phosphorus-containing acid.

Another optional component is (G) a component of dissolved, stably suspended, or both dissolved and stably suspended organic substances that reduce, and/or organic substances produced by reducing, hexavalent chromium previously present in the composition to trivalent chromium. Preferably, any reductant used to convert initial hexavalent chromium content, if present, to trivalent chromium produces from itself when oxidized only water and gaseous products such as carbon dioxide, which escape from the compositions during manufacture of same. However, some reductants or products formed by oxidation of the reductant may remain in a composition according to the invention as optional component (G), such as for example sorbitol and/or reaction products of sorbitol with other ingredients in the solution including but not limited to Cr (VI).

Optional component (H) at least one dissolved inorganic metal compound may be included for a variety of reasons such as, by way of non-limiting example, to improve corrosion resistance of the passivated metal surface and/or to initiate deposition of the coating. The dissolved inorganic metal compound is soluble in the working bath and metal ions therefrom can be incorporated into the coating. Desirably, component (H) is soluble in both the working bath and any concentrate for making the working bath. Suitable examples of component (H) include oxides and carbonates of Co, Ni, Si and Zn. Desirably, amounts of Zn range between about 50 ppm to 1500 ppm in the working bath. Independently, amounts of Co are desirably in the range of 0.1-50 g/l.

To facilitate the coating process, one or more materials corresponding to optional component (I) at least one further additive selected from the group consisting of a sequestrant, a wetting agent, and a defoamer may be used. The selection of types and amounts of such materials is within the knowledge and skill of one of ordinary skill in the art and can be made without undue experimentation.

In a related aspect of the invention, a storage stable concentrate is provided for making up the working baths by dilution with water only. By storage stable, it is meant that the concentrate develops less than, in increasing order of preference, 10, 7.5, 5, 4, 3, 2, 1 wt % precipitate after storage at 120 degrees Fahrenheit for, in increasing order of preference 1, 2, 3, 4, 5, 6, 7, 8, 12, 16, 20, 24 weeks. Stable concentrates may, by way of non-limiting example, comprise, consist essentially of, or consist of 10-30 wt % of a component of dissolved phosphate ions; 2-8 wt % of a component of dissolved trivalent chromium; 1-20 wt % of a component of dissolved anions of at least one complex fluoride of an element selected from the group consisting of Ti, Zr, Hf, Si, Sn, Al, Ge and B; preferably Ti, Si and/or Zr; 0.01 to 0.09 wt % of a component of organic acid inhibitor, preferably comprising quaternary ammonium compounds. The concentrates may also comprise one or more of the following optional components, in amounts, where present, of: a component of dissolved free fluoride ions in amounts of zero to 2 wt %; a pH adjusting component in an amount sufficient to provide a pH of 0.2 to 5.0 to the concentrate; a component of dissolved, stably suspended, or both dissolved and stably suspended organic substances that reduce, and/or organic substances produced by reducing, hexavalent chromium previously present in the composition to trivalent chromium; one or more dissolved inorganic metal compounds, as described above, where if an inorganic Zn metal compound is present, desirably the amount of Zn metal in the concentrate is between 0.001 and 0.05 wt %, where if an inorganic Co metal compound is present, desirably the amount of Co metal in the concentrate is between 0.01 and 0.5 wt %, where if an inorganic Ni metal compound is present, desirably the amount of Ni metal in the concentrate is between 0.01 and 0.5 wt %; and (I) at least one further additive selected from the group consisting of a sequestrant, a wetting agent, and a defoamer.

Concentrates according to the invention can be used at full strength if desired, for example when using an applicator pen or brush, or when repairing a coated substrate. When diluted for use in a working bath, such as for spraying, roller coating or immersion, dilutions of 1 wt % concentrate in water up to full strength use of the concentrate may be selected. Desirably, if only for economic reasons, the concentrate is used in dilutions of 1-50 wt %. In a preferred embodiment, the concentrate is a 5 wt % concentrate to 75 wt % concentrate in water, most preferably 10-50 wt %.

In a different aspect of the invention, a process of treating a zinciferous metal substrate is provided comprising: optionally, cleaning a surface of said metal substrate to be passivated; contacting the metal substrate surface to be passivated with a passivating composition as described herein for a time sufficient to form a coating on said metal surface and drying the coating. This process may include the step of coating a precursor metal substrate, such as a ferriferous metal, with a zinciferous metal, thereby creating a metal substrate surface to be passivated, prior to contacting with the passivating composition. Optionally, a process according to the invention may include a step wherein the passivating coating on the metal surface is overcoated with a protective layer comprising at least one organic binder.

Where galvanized metal surfaces are mentioned in connection with the present invention, they are understood to be material surfaces of electrolytically galvanized or hot-dip-galvanized or even alloy-galvanized steel, preferably electrolytically galvanized or hot-dip-galvanized steel strip. The use of galvanized steel, particularly electrolytically galvanized steel in strip form, has grown considerably in significance in recent years. The expression "galvanized steel" in the context of the present invention is understood to encompass electrolytically galvanized steel and also hot-dip-galvanized steel and also applies generally to alloy-galvanized steel, zinc/nickel alloys, zinc/iron alloys (Galvanneal™,) and zinc/aluminum alloys (GALFAN®, from Eastern Alloys, Inc., of Maybrook, N.Y., Galvalume® from BIEC International, Inc. of Vancouver, Wash.).

The practice of this invention may be further appreciated by consideration of the following, non-limiting examples, and the benefits of the invention may be appreciated by the examples set forth below.

EXAMPLES

Cleaning Procedure

All panels coated, unless otherwise specified, were 4"×12" hot-dipped galvanized (HDG) G70 panels from ACT Laboratories. The panels, unless otherwise specified, were spray cleaned with 2.5% by volume in tap water (vol./vol.) of Parcolene 1200 (commercially available from Henkel Corporation, Madison Heights, Mich.). Cleaning was at 140° F. for 10-15 seconds. The panels were rinsed with hot (about 130° F.) for approximately 15 seconds, drained for 5 seconds squeegeed on a smooth roller and flash air dried.

Coating Procedure

All panels were coated, unless otherwise indicated, by applying a horizontal line of one of the treatment compositions near the top of the panel and then spreading the coating downward over the panel surface with a #3 draw down bar. All treatment solutions were room temperature and were applied to room temperature panels unless otherwise indicated.

Testing Procedure

Neutral Salt Spray testing was performed according to ASTM B-117. The Stack and Cleveland tests were performed according standard industry procedures as is known in the art.

Gloss of panels was measured using a Novo-gloss™ Elcometer 402 with a light incident angle of 60°. The higher the result the glossier the coating.

Resistivity: A Loresta EP meter was used for measuring resistivity of the coated panels, and was run in manual mode at lowest ($\times 10^{-2}$) scale, for example a reading of $0.011\times10^{-2}=0.11$ milliohm. Resistivity is a measure of the ability of the coated panel to dissipate static electricity. The lower the resistivity, the better a coated panel can dissipate static, which is significant in the electronics industries. In each case, eight measurements were made with readings <1 milliohm being considered as a "pass". Reporting is made of the number of "pass" readings of the eight measurements made.

Example 1

Formulations:

Ex. 165A: A nitrate-free, trivalent chromium containing passivate was made as a base formula and control according to the procedure below:

To a covered stainless steel beaker equipped with a stir-bar, with continued mixing added 2770 g DI water, 3440.0 g 75% H3PO4 (26.3 moles), 923.2 g (9.23 moles) $CrO_3$, slowly added 288.0 g 70% sorbitol solution while keeping temperature <80 C, post heat 80 C/3 hrs. Test for Cr+6 (<1 ppm via acid-iodide+starch indicator) and let cool. Total weight adjusted to 7600 g. 810 g 48% rgt HF (1.93 moles), and then 37.6 g $CoCO_3$ were slowly added. After the $CoCO_3$ was dissolved (with gassing) the total weight adjusted to 9600 g to give a 5.0 wt % Cr+3 solution.

Working solutions were made by diluting 30 g of Ex 165A to 100 g total with deionized water and then incorporating additives according to Table 1:

TABLE 1

| Example | Additive |
|---|---|
| Ex. 175A (Control) | None |
| Ex. 175B | 0.10 g OAI 1 |
| Ex. 175C | 0.50 g OAI 1 |
| Ex. 176A | 0.10 g ferrous phosphate |
| Ex. 176B | 0.10 g OAI 3 |
| Ex. 176C | 0.50 g OAI 3 |

Organic Acid Inhibitor 1 (hereinafter OAI 1) comprises quinolinium halides, including an aryl quinolinium halide in amounts 9-11.25 wt %.

Organic Acid Inhibitor 3 (hereinafter OAI 3) comprises 4 wt % polyalkylenepolyamine arylhalide quaternized polymers with glyoxal, 18.6 wt % hexamethylenetetramine xHCl and 2 wt % ethoxylated fatty amine.

0.5×2.0" pure zinc coupons were cleaned with isopropyl alcohol and a Scotch-brite pad and rinsed with water. For each example recited below, cleaned coupons were contacted with a working bath according to Table 1 without agitation, and the loss of metal from the coupons after contact for the indicated time periods was measured, see Table 2. The build-up of zinc in the working baths was then calculated, see Table 3.

TABLE 2

| Example | loss 30 min | % inhibition @ 30 min | loss 60 min |
|---|---|---|---|
| Ex. 175A | 0.2794 g | 0 | 0.2843 |
| Ex. 175B | 0.0054 g | 98.1 | 0.0083 |
| Ex. 175C | 0.0015 g | 99.5 | 0.0011 |
| Ex. 176A | 0.2626 g | 6.0 | 0.2613 |
| Ex. 176B | 0.0358 g | 87.2 | 0.0346 |
| Ex. 176C | 0.0166 g | 94.1 | 0.0183 |

TABLE 3

| | Exposure time | mg/kg Zn |
|---|---|---|
| Ex. 175A-0 | 0 | 0 |
| Ex. 175B-2 | 60 min | 173 |
| Ex. 175C-2 | 60 min | 26 |
| Ex. 176A-1 | 60 min | 5239 |
| Ex. 176B-1 | 60 min | 704 |
| Ex. 176C-1 | 60 min | 349 |

Example 2

Formulations:

Ex. 177AC: Another trivalent chromium containing passivate concentrate, was made according to the formulation of Table 4 in the same methods as example 1. Concentrate Ex. 177AC was a lower phosphate version of Ex. 165A (1:2.0 mole ratio Cr:$PO_4$ vs. the 1:2.9 mole ratio of Ex. 165A) and more concentrated, where 90 g=100 g of Ex. 165A (based on Cr, Co, HF content).

TABLE 4

| Component | Amount (g) |
|---|---|
| Phosphoric Acid 75% | 260.0 |
| Hydrofluoric Acid 48% | 10.0 |
| Chromic Acid, Flake | 99.0 |
| Sorbitol 70% Solution | 36.0 |
| Cobalt Carbonate | 4.7 |
| Water, deionized | Remainder to 900.0 g |

Working solutions of Table 4 were made by diluting 27.0 g of Ex. 177AC to 100 g total with deionized water and then incorporating additives according to Table 5:

TABLE 5

| Example | Additive |
|---|---|
| Ex. 177A | None |
| Ex. 177B | 0.10 g OAI 1 |
| Ex. 177C | 0.50 g OAI 1 |
| Ex. 178A | 0.10 g ferrous phosphate |
| Ex. 178B | 0.10 g OAI 3 |
| Ex. 178C | 0.50 g OAI 3 |

The procedure of Example 1 was repeated with fresh 0.5×2.0" pure zinc panels and the formulations of Table 5, with the results shown in Tables 6 and 7 below.

TABLE 6

| Example | loss 30 min | % inhibition@30 min | loss 60 min |
|---|---|---|---|
| Ex. 177A | 0.0875 | 0 | 0.0969 |
| Ex. 177B | 0.0059 | 93.3 | 0.0115 |
| Ex. 177C | 0.0021 | 97.6 | 0.0024 |
| Ex. 178A | 0.0741 | 14.2 | 0.0474 |
| Ex. 178B | 0.0126 | 85.6 | 0.0287 |
| Ex. 178C | 0.0101 | 88.5 | 0.0165 |

TABLE 7

| | Exposure time | mg/kg Zn | Panels run? | Appearance* |
|---|---|---|---|---|
| Ex. 177A-1 | 30 min | 875 | no | sludge |
| Ex. 177A-2 | 60 min | 2259 | no | sludge |
| Ex. 177A-3 | 3.0 hrs | 3859 | no | sludge |
| Ex. 177B-1 | 30 min | 59 | yes | okay |
| Ex. 177B-2 | 60 min | 223 | no | sludge |
| Ex. 177B-3 | 3.0 hrs | 2813 | no | sludge |
| Ex. 177C-1 | 30 min | 21 | yes | okay |
| Ex. 177C-2 | 60 min | 55 | yes | okay |
| Ex. 177C-3 | 3.0 hrs | 643 | no | sludge |
| Ex. 178A-1 | 30 min | 741 | no | sludge |
| Ex. 178A-2 | 60 min | 1418 | no | sludge |
| Ex. 178B-1 | 30 min | 126 | no | sludge |
| Ex. 178B-2 | 60 min | 536 | no | sludge |

*Appearance of solution after aging 2 days.

Example 3

New working solutions of trivalent chromium containing passivate were made based on Concentrate Ex. 177AC. Working solutions of Table 8 were made by combining 27.0 g of Ex. 177AC with 3.0 g 70% glycolic acid, diluting to 100 g total with deionized water and then incorporating additives according to Table 8:

TABLE 8

| Example | Additive |
|---|---|
| Ex. 179A | None |
| Ex. 179B | 0.1 g OAI 1 |
| Ex. 179C | 0.5 g OAI 1 |

The procedure of Example 1 was repeated with fresh 0.5×2.0" pure zinc panels and the formulations of Table 8, with the results shown in Tables 9 and 10 below.

TABLE 9

| Example | loss 30 min | % inhibition@30 min | loss 60 min |
|---|---|---|---|
| Ex. 179A | 0.0533 | 0 | 0.0802 |
| Ex. 179B | 0.0042 | 92.1 | 0.0061 |
| Ex. 179C | 0.0019 | 96.4 | 0.0013 |

TABLE 10

| | Exposure time | mg/kg Zn |
|---|---|---|
| Ex. 179A-2 | 60 min | 1679 |
| Ex. 179B-2 | 60 min | 129 |
| Ex. 179C-2 | 60 min | 38 |

Example 4

New working solutions of trivalent chromium containing passivate were made based on Concentrate Ex. 177AC. Working solutions of Table 11 were made by combining 27.0 g of Ex. 177AC with 3.0 g 25% $H_2SiF_6$, diluting to 100 g total with deionized water and then incorporating additives according to Table 11:

TABLE 11

| Example | Additive |
|---|---|
| Ex. 180B | None |
| Ex. 180C | 0.1 g OAI 1 |
| Ex. 180D | 0.5 g OAI 1 |

The procedure of Example 1 was repeated with fresh 0.5×2.0" pure zinc panels and the formulations of Table 11, with the results shown in Tables 12 below.

TABLE 12

| Example | loss 30 min | % inhibition@30 min | loss 60 min |
|---|---|---|---|
| Ex. 180B | 0.1394 | 0 | 0.1088 |
| Ex. 180C | 0.0032 | 97.7 | 0.0030 |
| Ex. 180D | 0.0011 | 99.2 | 0.0006 |

Testing of Panels Coated using Examples 1-4

4"×12" hot-dipped galvanized (HDG) G70 panels from ACT Laboratories were coated using the working baths of Examples 1, 2, 3 and 4 (20 g+10 g DI water each) as well as several commercially available comparative examples, as shown in Table A. After coating with the composition of the working solution with the use of a wire wound #3 draw-down bar, each panels was placed under an infra-red oven until dry. Gloss and resistivity evaluations were performed on the bottom portion of each panel. Gloss of the coating was assessed using the following procedure: Gloss of panels was measured five times and averaged using a Novo-gloss™ Elcometer 402 with a light incident angle of 60°. The higher the numerical result the glossier the coating.

Resistivity of the panels, was assessed by testing 8 panel areas subjected to the same treatment according to the following procedure: A Loresta EP meter was used for measuring resistivity of the coated panels, and was run in manual mode at lowest ($\times 10^{-2}$) scale, for example a reading of $0.011\times 10^{-2}$=0.11 milliohm. Resistivity is a measure of the ability of the coated panel to dissipate static electricity. The lower the resistivity, the better a coated panel can dissipate static, which is significant in the electronics industries. In each case, eight measurements were made with readings <1 milliohm being considered as a "pass". Reporting is made of the number of "pass" readings of the eight measurements made.

The panels were then exposed to Neutral Salt Spray according to ASTM B117. These results are also shown in Table A.

TABLE A

| | | Neutral Salt Spray Exposure Time (hr) | | | | | | Resistivity # of panels |
|---|---|---|---|---|---|---|---|---|
| Panel | Formula | 24 | 48 | 72 | 96 | 168 | Gloss avg/5 | that passed out of 8 |
| | | % corrosion of panels | | | | | | |
| 2 | ⅔ Ex. 175A-0 | 0.1 | 10.0 | 20.0 | 30.0 | 50.0 | 157.1 | 1 |
| 17 | ⅔ Ex. 175B-2 | 1.0 | 10.0 | 15.0 | 30.0 | 50.0 | 205.2 | 2 |
| 20 | ⅔ Ex. 175C-2 | 10.0 | 10.0 | 30.0 | 40.0 | 60.0 | 190.0 | 3 |
| 23 | ⅔ Ex. 176A-1 | 0.0 | 0.0 | 0.1 | 0.1 | 5.0 | 165.2 | 4 |
| 26 | ⅔ Ex. 176B-1 | 0.1 | 2.0 | 5.0 | 10.0 | 20.0 | 189.2 | 2 |
| 29 | ⅔ Ex. 176C-1 | 0.1 | 1.0 | 2.0 | 2.0 | 15.0 | 197.8 | 5 |
| 38 | ⅔ Ex. 177B-1 | 0.0 | 0.0 | 0.1 | 5.0 | 20.0 | 109.7 | 4 |
| 41 | ⅔ Ex. 177C-1 | 0.1 | 1.0 | 10.0 | 10.0 | 25.0 | 30.8 | 4 |
| 44 | ⅔ Ex. 177C-2 | 0.1 | 1.0 | 10.0 | 10.0 | 25.0 | 50.1 | 5 |
| 56 | ⅔ Ex. 179A-2 | 0.0 | 0.1 | 0.1 | 0.1 | 5.0 | 90.2 | 1 |
| 59 | ⅔ Ex. 179B-2 | 0.0 | 1.0 | 1.0 | 1.0 | 10.0 | 190.0 | 5 |
| 62 | ⅔ Ex. 179C-2 | 0.0 | 2.0 | 5.0 | 5.0 | 15.0 | 211.2 | 4 |
| 86 | ⅔ Ex. 180B | 0.0 | 0.0 | 0.0 | 0.0 | 5.0 | 125.8 | 2 |
| 89 | ⅔ Ex. 180C | 0.0 | 0.0 | 1.0 | 1.0 | 10.0 | 138.2 | 6 |
| 94 | 60% Comp. Ex. 1 | 0.0 | 0.0 | 0.0 | 0.0 | 1.0 | 47.2 | 0 |
| 95 | 40% Comp. Ex. 1 | 0.0 | 0.0 | 1.0 | 5.0 | 10.0 | 68.0 | 2 |
| 96 | 30% Comp. Ex. 1 | 0.0 | 5.0 | 5.0 | 5.0 | 10.0 | 77.1 | 7 |
| 97 | 30% Comp. Ex. 2 | 0.0 | 0.0 | 5.0 | 15.0 | 60.0 | 134.2 | 2 |

Comp. Ex. 1 (Ex. 136A) is a fluoride-free commercially available trivalent chromium nitrate/phosphate and cobalt containing passivate with 6% added dispersed fumed silica.

Comp. Ex. 2 (6020) is a currently commercially available trivalent chromium, nitrate, phosphate, fluoride and cobalt containing passivate which contained a trace (<20ppm) Cr+6.

Example 5

Formulations:

Two trivalent chromium containing passivate concentrates, retaining the lowered phosphate level were prepared with the $H_2SiF_6$ present during the reduction stage. This shows attempt to eliminate free HF. The $H_2SiF_6$ was not adequate to eliminate all free HF. Ex. 183A and Ex. 184A, were made in the same methods as example 1, according to the formulation of Table 13.

TABLE 13

| Component | Ex. 183A (g) | Ex 184A (g) |
|---|---|---|
| Phosphoric Acid 75% | 960 | 960 |
| Hydrofluoric Acid 48% | — | 38.2 |
| Chromic Acid, Flake | 360 | 360 |
| Sorbitol 70% Solution | 124.0 | 124.0 |
| $H_2SiF_6$ 25% | 1040 | — |
| Water, deionized | 1200 | 1975 |
| Total weight | 3556 | 3182 |

Ex. 183A: Had total 5.264% Cr and tested at <1 ppm Cr+6. Solution had fine white sandy sludge which appeared to be $SiO_2$. Filtrate was rinsed, dried at 150° F. under vacuum and weighed. The filtrate mass was 10.84 g which is 20% of theoretical maximum based on 100% SiO2.

It is assumed that an equivalent amount of F— was released through this partial decomposition. Ex. 184A: Had total 5.88% Cr and required an additional 2 hr/85 C to achieve <1 ppm Cr+6. Solution was clear.

Example 6

New formulations with varying amounts of phosphoric acid were prepared as follows. Note that the use of $H_2SiF_6$ and HF together during the reduction does allow lower phosphate levels while preventing sludge. SS test panels were used to determine effect on manufacturing equipment:

Ex. 209B: 1375 g DI water, 960 g 75% $H_3PO_4$ (7.35 moles), 76.4 g 48% rgt HF (1.82 moles), 360 g (3.6 moles) $CrO_3$, 124.0 g 70% sorbitol, post heat 80 C/3 hrs=<1 ppm Cr+6. Total weight adjusted to 2880 g=6.50% as Cr. 1.00:2.04 Cr:$PO_4$ Ex. 210C: 1500 g DI water, 816.7 g 75% $H_3PO_4$ (6.25 moles), 76.4 g 48% rgt HF (1.82 moles), 360 g (3.6 moles) $CrO_3$, 124.0 g 70% sorbitol, post heat 80 C/3 hrs=<1 ppm Cr+6. Total weight adjusted to 2880 g=6.50% as Cr. ~1 g hard green scale was observed at the water-line. 1.00:1.74 Cr:$PO_4$ Ex. 229A: 1600 g DI water, 720.0 g 75% $H_3PO_4$ (5.51 moles), 76.4 g 48% rgt HF (1.82 moles), 561.6 g 25% $H_2SiF_6$ (0.974 moles), 360 g (3.6 moles) $CrO_3$, 124.0 g 70% sorbitol, post heat 80 C/3 hrs=<1 ppm Cr+6. Total weight adjusted to 3566 g=5.25% as Cr. Reactor very clean. Note: 2×2" SS panels suspended during reduction and overnight cooling. 304/316 alloys=no visual effect or weight loss detected. 1.00:1.53 Cr:$PO_4$ Ex. 215A: 1500 g DI water, 624.0 g 75% $H_3PO_4$ (4.78 moles), 76.4 g 48% rgt HF (1.82 moles), 561.6 g 25% $H_2SiF_6$ (0.974 moles), 360 g (3.6 moles) $CrO_3$, 124.0 g 70% sorbitol, post heat 80 C/3 hrs=<1 ppm Cr+6. Total weight adjusted to 3566 g=5.25% as Cr. Reactor very clean. Note: 2×2" SS panels suspended during reduction. 304/316 alloys=no visual effect or weight loss detected. 1.00:1.33 Cr:$PO_4$ Ex. 216E (Comparative Ex. 4): 1250 g DI water, 939.7 g 75% $H_3PO_4$ (7.20 moles), 360 g (3.6 moles) $CrO_3$, 211.3 g 50% gluconic acid, post heat 80 C/2 hrs=<1 ppm Cr+6. Some deposit at water-line ~0.5 g insolubles. Note: 2×2" SS panels suspended during reduction. 304/316 alloys=no visual effect or weight loss detected. After adjusting weight to 2791.0 g with DI water, mixed in 1860.6 g $Cr(NO_3)_3$ (10% solution), 23.4 g urea prill, mixed 15 min and bottled. 30 g in 2 oz plastic bottle, air evacuated and 175 F/90 min heat-bath and cool=no gassing. 1.00:2.00 Cr:$PO_4$ Example 7

Ex. 230D: 769.23 g Ex. Ex. 230E: 769.23 g Ex. 210C+150.0 g 25% $H_2SiF_6$+40.0 g 70% glycolic acid+3.0 g OAI 1+37.77 g DI water.

Ex. 230F: 952.38 g Ex. 215A+40.0 g 70% glycolic acid+3.0 g OAI 1+4.62 g DI Water Ex. 230G: 952.38 g Ex. 229A+40.0 g 70% glycolic acid+3.0 g OAI 1+4.62 g DI Water Ex. 230H: 952.38 g Ex. 229A+3.0 g OAI 1+44.62 g DI Water Ex. 242A: 500 g Ex. 230G+0.156 g ZnO (250 ppm as Zn). Mix and sit 24 hrs Testing of Panels Coated using Examples 5-7

After coating with the composition of the working solution with the use of a wire wound #3 draw-down bar, each panel (pre-warmed to 95° F.) was allowed to air dry.

TABLE B

| | | Neutral Salt Spray Exposure Time (hr) | | | |
|---|---|---|---|---|---|
| | | 120 | 144 | 192 | 216 |
| Panel | Formula | % corrosion of panels | | | |
| 1 | 15% Comp. Ex. 2 (6020) | 40.0 | 50.0 | ND | ND |
| 2 | 7.5% Comp. Ex. 2 (6020) | 30.0 | 40.0 | 60.0 | ND |
| 3 | 15% Ex. 216E (Comparative Ex. 4) | 80.0 | ND | ND | ND |
| 4 | 75% Ex. 216E (Comparative Ex. 4) | 80.0 | ND | ND | ND |
| 7 | 15% Ex. 230D | 5.0 | 15.0 | 20.0 | 30.0 |
| 8 | 7.5% Ex. 230D | 5.0 | 10.0 | 20.0 | 20.0 |
| 9 | 15% Ex. 230E | 5.0 | 5.0 | 10.0 | 20.0 |
| 10 | 7.5% Ex. 230E | 40.0 | 40.0 | 50.0 | ND |
| 11 | 15% Ex. 230F | 5.0 | 10.0 | 15.0 | 20.0 |
| 12 | 7.5% Ex. 230F | 10.0 | 15.0 | 40.0 | 60.0 |
| 13 | 15% Ex. 230G | 10.0 | 15.0 | 15.0 | 40.0 |
| 14 | 7.5% Ex. 230G | 50.0 | ND | ND | ND |
| 15 | 15% Ex. 230H | 40.0 | 50.0 | ND | ND |
| 16 | 7.5% Ex. 230H | 60.0 | ND | ND | ND |

Testing of Panels Coated using Example 7 with Roller-coater

4"×12" hot-dipped galvanized (HDG) G70 panels from ACT Laboratories were coated using the compositions as listed in Table C, at various dilutions, including commercially available comparative examples. Compositions were applied using ~1½ cranks of a grooved roller coater to better approximate industrial usage. Four heating variations were used: No heat (NH); a preheating of the panels for 60 sec with a blower at ~95 F (MH); a preheating of the panels for 60 sec with a blower ~110 F (HH); or a post-coating bake in an infra-red oven for 12 sec (IR). Coating weight was measured according to the following procedure: Henkel Analytical Method 305B: a Model 2501 Portaspec x-ray fluorescence machine. The coated panel was placed in the Portaspec and "counts" for chromium were made and compared to the "counts" for a control having a known coating weight and chromium content. Based on the proportional counts, above the background measurement, which was taken from the blank, the coating weight was calculated. Gloss and resistivity evaluations were performed on the bottom portion of each panel according the procedure recited herein.

TABLE C

| | | Wt % | Heat | Coating Weight[1] | Resistivity <1 mohm # of panels that passed out of 8 | Gloss[2] Avg. of five |
|---|---|---|---|---|---|---|
| 9 | Comp. Ex. 4 | 30 | NH | 5.80 | 5 | 87 |
| 10 | | " | MH | 4.67 | 7 | 114 |
| 11 | | " | HH | 4.56 | 7 | 121 |
| 12 | | " | IR | 5.69 | 7 | 124 |
| 17 | Comp. Ex. 2 | 30 | NH | 5.10 | 4 | 17.2 |
| 18 | | " | MH | 4.41 | 5 | 61.0 |
| 19 | | " | HH | 4.00 | 7 | 110 |
| 20 | | " | IR | 5.04 | 6 | 29.9 |
| 25 | Ex. 230G | 30 | NH | 3.54 | 7 | 120 |
| 26 | | " | MH | 2.86 | 8 | 96.0 |
| 27 | | " | HH | 2.50 | 8 | 102 |
| 28 | | " | IR | 3.80 | 8 | 110 |
| 33 | Ex. 242A | 30 | NH | 3.70 | 8 | 122 |
| 34 | | " | MH | 2.92 | 8 | 106 |
| 35 | | " | HH | 2.75 | 8 | 102 |
| 36 | | " | IR | 3.72 | 8 | 115 |

[1]used factor = 1000 counts/mg,
[2]clean only gloss = 192.

Panels coated according to Table C were exposed to Neutral Salt Spray according to ASTM B117. The results of the testing are shown in Table D.

TABLE D

| | Neutral Salt Spray Exposure Time (hr) | | | | | | |
|---|---|---|---|---|---|---|---|
| Panel | 24 | 48 | 72 | 96 | 168 | 264 | 552 |
| | % corrosion of panels | | | | | | |
| 9 | 10.0 | 15.0 | 15.0 | 20.0 | 50.0 | ND | ND |
| 10 | 1.0 | 2.0 | 10.0 | 10.0 | 20.0 | 80.0 | ND |
| 11 | 5.0 | 10.0 | 15.0 | 20.0 | 50.0 | ND | ND |
| 12 | 5.0 | 10.0 | 15.0 | 20.0 | 50.0 | ND | ND |
| 18 | 0.0 | 0.0 | 0.0 | 0.0 | 5.0 | 70.0 | ND |
| 19 | 0.0 | 0.0 | 0.0 | 0.0 | 10.0 | 60.0 | ND |
| 20 | 0.0 | 0.0 | 0.0 | 0.0 | 10.0 | 70.0 | ND |
| 25 | 0.0 | 0.0 | 0.0 | 0.0 | 0.0 | 5.0 | 100.0 |
| 26 | 0.0 | 0.0 | 0.0 | 0.0 | 1.0 | 15.0 | 100.0 |
| 27 | 0.0 | 1.0 | 1.0 | 1.0 | 1.0 | 15.0 | 100.0 |
| 28 | 0.0 | 1.0 | 1.0 | 1.0 | 5.0 | 20.0 | 100.0 |
| 33 | 0.0 | 0.0 | 0.0 | 0.0 | 1.0 | 2.0 | 100.0 |
| 34 | 0.0 | 0.0 | 0.0 | 0.0 | 1.0 | 5.0 | 100.0 |
| 35 | 0.0 | 0.0 | 0.0 | 0.0 | 1.0 | 10.0 | 100.0 |
| 36 | 0.0 | 0.0 | 0.0 | 0.0 | 2.0 | 15.0 | 100.0 |

Panels coated according to Table C were tested for corrosion resistance to stacking. The results of the testing are shown in Table E.

TABLE E

| | Coat | Stack Test Exposure Time (hr) | | | | | | | | | | | |
|---|---|---|---|---|---|---|---|---|---|---|---|---|---|
| Panel | from Table E | 168 | 336 | 504 | 672 | 840 | 1008 | 1176 | 1344 | 1512 | 1680 | 1848 | 2016 |
| | | % corrosion of panels | | | | | | | | | | | |
| 9 | 9 | 1.0 | nr | 15.0 | 15.0 | 15.0 | 20.0 | 20.0 | 20.0 | 20.0 | 30.0 | 30.0 | 30.0 |
| 10 | | 1.0 | nr | 15.0 | 15.0 | 15.0 | 20.0 | 20.0 | 20.0 | 20.0 | 30.0 | 30.0 | 30.0 |
| 11 | 10 | 0.1 | nr | 15.0 | 15.0 | 15.0 | 15.0 | 20.0 | 30.0 | 30.0 | 30.0 | 30.0 | 30.0 |
| 12 | | 0.1 | nr | 15.0 | 15.0 | 15.0 | 15.0 | 20.0 | 30.0 | 30.0 | 30.0 | 30.0 | 30.0 |
| 13 | 11 | 0.0 | nr | 15.0 | 15.0 | 15.0 | 15.0 | 20.0 | 30.0 | 30.0 | 30.0 | 30.0 | 30.0 |
| 14 | | 0.0 | nr | 15.0 | 15.0 | 15.0 | 15.0 | 20.0 | 30.0 | 30.0 | 30.0 | 30.0 | 30.0 |
| 15 | 12 | 1.0 | nr | 15.0 | 15.0 | 15.0 | 20.0 | 20.0 | 30.0 | 30.0 | 30.0 | 30.0 | 30.0 |
| 16 | | 1.0 | nr | 15.0 | 15.0 | 15.0 | 20.0 | 20.0 | 30.0 | 30.0 | 30.0 | 30.0 | 30.0 |
| 27 | 18 | 0.0 | nr | 30.0 | 30.0 | 30.0 | 50.0 | ND | ND | ND | ND | ND | ND |
| 28 | | 0.0 | nr | 30.0 | 30.0 | 30.0 | 50.0 | ND | ND | ND | ND | ND | ND |
| 29 | 19 | 0.1 | nr | 15.0 | 30.0 | 50.0 | ND | ND | ND | ND | ND | ND | ND |
| 30 | | 0.1 | nr | 15.0 | 30.0 | 50.0 | ND | ND | ND | ND | ND | ND | ND |
| 31 | 20 | 1.0 | nr | 10.0 | 15.0 | 50.0 | ND | ND | ND | ND | ND | ND | ND |
| 32 | | 1.0 | nr | 10.0 | 15.0 | 50.0 | ND | ND | ND | ND | ND | ND | ND |
| 41 | 25 | 0.0 | nr | 1.0 | 5.0 | 5.0 | 5.0 | 10.0 | 20.0 | 50.0 | ND | ND | ND |
| 42 | | 0.0 | nr | 1.0 | 5.0 | 5.0 | 5.0 | 10.0 | 20.0 | 50.0 | ND | ND | ND |
| 43 | 26 | 0.0 | nr | 1.0 | 5.0 | 5.0 | 10.0 | 30.0 | 50.0 | ND | ND | ND | ND |
| 44 | | 0.0 | nr | 1.0 | 5.0 | 5.0 | 10.0 | 30.0 | 50.0 | ND | ND | ND | ND |
| 45 | 27 | 0.0 | nr | 1.0 | 5.0 | 5.0 | 10.0 | 20.0 | 50.0 | ND | ND | ND | ND |
| 46 | | 0.0 | nr | 1.0 | 5.0 | 5.0 | 10.0 | 20.0 | 50.0 | ND | ND | ND | ND |
| 47 | 28 | 0.0 | nr | 1.0 | 5.0 | 5.0 | 5.0 | 20.0 | 50.0 | ND | ND | ND | ND |
| 48 | | 0.0 | nr | 1.0 | 5.0 | 5.0 | 5.0 | 20.0 | 50.0 | ND | ND | ND | ND |
| 57 | 33 | 0.0 | nr | 1.0 | 5.0 | 15.0 | 30.0 | 30.0 | 30.0 | 60.0 | ND | ND | ND |
| 58 | | 0.0 | nr | 1.0 | 5.0 | 15.0 | 30.0 | 30.0 | 30.0 | 60.0 | ND | ND | ND |
| 59 | 34 | 0.0 | nr | 1.0 | 1.0 | 5.0 | 10.0 | 20.0 | 30.0 | 50.0 | ND | ND | ND |
| 60 | | 0.0 | nr | 1.0 | 1.0 | 5.0 | 10.0 | 20.0 | 30.0 | 50.0 | ND | ND | ND |
| 61 | 35 | 0.0 | nr | 1.0 | 1.0 | 5.0 | 10.0 | 30.0 | 50.0 | ND | ND | ND | ND |
| 62 | | 0.0 | nr | 1.0 | 1.0 | 5.0 | 10.0 | 30.0 | 50.0 | ND | ND | ND | ND |
| 63 | 36 | 1.0 | nr | 1.0 | 1.0 | 5.0 | 10.0 | 30.0 | 50.0 | ND | ND | ND | ND |
| 64 | | 1.0 | nr | 1.0 | 1.0 | 5.0 | 10.0 | 30.0 | 50.0 | ND | ND | ND | ND |

Note that the stack test uses both the top and bottom of the same panel in the same test.

Example 8

New formulations were prepared as follows:

Ex. 244A: 500 g Ex. 230H+0.156 g ZnO (250 ppm as Zn). Mix and allow to age for 24 hrs.

Ex. 244B: 500 g Ex. 242A+12.8 g 75% $H_3PO_4$. Mix and allow to age for 24 hrs.

Ex. 244C: 421 g Ex. 230H+10.79 g 75% $H_3PO_4$+0.131 g ZnO (250 ppm as Zn). Mix and allow to age for 24 hrs.

Ex. 230G: Like Ex. 242A, but no Zn

The procedure for coating and testing from Example 7 (with roller-coater) was repeated with fresh panels using the formulations recited above. The results of the testing are shown in Table F, G and H.

TABLE F

| | | Wt % | Heat | Coating Weight[1] | Resistivity <1 mohm # of tests passed/8 | Gloss[2] Avg. of five |
|---|---|---|---|---|---|---|
| 1 | Ex. 244A | 20 | NH | 2.17 | 8 | 102 |
| 2 | | " | MH | 1.79 | 8 | 126 |
| 3 | | " | HH | 1.51 | 8 | 148 |
| 4 | | " | IR | 2.03 | 8 | 101 |
| 9 | Ex. 244B | 20 | NH | 2.06 | 8 | 110 |
| 10 | | " | MH | 1.73 | 8 | 126 |
| 11 | | " | HH | 1.66 | 8 | 109 |
| 12 | | " | IR | 2.12 | 8 | 99 |
| 17 | Ex. 244C | 20 | NH | 2.03 | 8 | 115 |
| 18 | | " | MH | 1.67 | 8 | 121 |
| 19 | | " | HH | 1.48 | 8 | 149 |
| 20 | | " | IR | 2.27 | 8 | 101 |
| 25 | Ex. 230G | 20 | NH | 2.25 | 8 | 112 |
| 26 | | " | MH | 1.64 | 8 | 112 |
| 27 | | " | HH | 1.51 | 8 | 121 |
| 28 | | " | IR | 2.19 | 8 | 93 |
| 37 | Ex. 242A | 20 | NH | 2.21 | 8 | 109 |
| 38 | | " | MH | 1.69 | 8 | 127 |
| 39 | | " | HH | 1.59 | 8 | 135 |
| 40 | | " | IR | 2.35 | 8 | 95 |

[1]used factor = 1000 counts/mg,
[2]clean only gloss = ND (~200)

TABLE G

| | Neutral Salt Spray Exposure Time (hr) | | | |
|---|---|---|---|---|
| | 24 | 48 | 72 | 384 |
| Panel | % corrosion of panels | | | |
| 1 | 0.1 | 1.0 | 2.0 | 100.0 |
| 2 | 0.1 | 0.1 | 2.0 | 100.0 |
| 3 | 5.0 | 10.0 | 30.0 | 100.0 |
| 4 | 1.0 | 1.0 | 5.0 | 100.0 |
| 9 | 0.0 | 0.0 | 0.0 | 90.0 |
| 10 | 0.0 | 0.0 | 0.0 | 100.0 |
| 11 | 0.0 | 0.1 | 1.0 | 100.0 |
| 12 | 0.0 | 0.0 | 0.0 | 80.0 |
| 17 | 0.1 | 1.0 | 5.0 | 90.0 |
| 18 | 0.1 | 1.0 | 10.0 | 100.0 |
| 19 | 5.0 | 20.0 | 40.0 | 100.0 |
| 20 | 1.0 | 2.0 | 20.0 | 100.0 |
| 25 | 1.0 | 1.0 | 2.0 | 90.0 |
| 26 | 0.1 | 0.1 | 1.0 | 100.0 |
| 27 | 1.0 | 2.0 | 5.0 | 100.0 |
| 28 | 0.1 | 1.0 | 1.0 | 90.0 |
| 37 | 0.0 | 0.0 | 1.0 | 90.0 |
| 38 | 0.0 | 0.0 | 0.0 | 100.0 |

TABLE G-continued

| | Neutral Salt Spray Exposure Time (hr) | | | |
|---|---|---|---|---|
| | 24 | 48 | 72 | 384 |
| Panel | % corrosion of panels | | | |
| 39 | 1.0 | 1.0 | 2.0 | 100.0 |
| 40 | 0.0 | 0.0 | 0.0 | 90.0 |

TABLE H

| | Coat | Stack Test Exposure Time (hr) | | | | | | | |
|---|---|---|---|---|---|---|---|---|---|
| | from | 168 | 336 | 504 | 672 | 840 | 1008 | 1176 | 1344 |
| Panel | Table H | % corrosion of panels | | | | | | | |
| 1 | 1 | nr | 10.0 | 10.0 | 15.0 | 15.0 | 30.0 | 60.0 | ND |
| 2 | | nr | 10.0 | 10.0 | 15.0 | 15.0 | 30.0 | 60.0 | ND |
| 3 | 2 | nr | 1.0 | 5.0 | 15.0 | 20.0 | 50.0 | ND | ND |
| 4 | | nr | 1.0 | 5.0 | 15.0 | 20.0 | 50.0 | ND | ND |
| 5 | 3 | nr | 1.0 | 10.0 | 15.0 | 30.0 | 50.0 | ND | ND |
| 6 | | nr | 1.0 | 10.0 | 15.0 | 30.0 | 50.0 | ND | ND |
| 7 | 4 | nr | 1.0 | 10.0 | 15.0 | 30.0 | 50.0 | ND | ND |
| 8 | | nr | 1.0 | 10.0 | 15.0 | 30.0 | 50.0 | ND | ND |
| 17 | 9 | nr | 1.0 | 1.0 | 5.0 | 15.0 | 30.0 | 40.0 | 60.0 |
| 18 | | nr | 1.0 | 1.0 | 5.0 | 15.0 | 30.0 | 40.0 | 60.0 |
| 19 | 10 | nr | 1.0 | 1.0 | 5.0 | 15.0 | 30.0 | 40.0 | 60.0 |
| 20 | | nr | 1.0 | 1.0 | 5.0 | 15.0 | 30.0 | 40.0 | 60.0 |
| 21 | 11 | nr | 1.0 | 5.0 | 5.0 | 20.0 | 50.0 | ND | ND |
| 22 | | nr | 1.0 | 5.0 | 5.0 | 20.0 | 50.0 | ND | ND |
| 23 | 12 | nr | 1.0 | 1.0 | 1.0 | 5.0 | 15.0 | 30.0 | 60.0 |
| 24 | | nr | 1.0 | 1.0 | 1.0 | 5.0 | 15.0 | 30.0 | 60.0 |
| 33 | 17 | nr | 5.0 | 5.0 | 10.0 | 15.0 | 30.0 | 40.0 | 50.0 |
| 34 | | nr | 5.0 | 5.0 | 10.0 | 15.0 | 30.0 | 40.0 | 50.0 |
| 35 | 18 | nr | 1.0 | 5.0 | 5.0 | 15.0 | 30.0 | 30.0 | 50.0 |
| 36 | | nr | 1.0 | 5.0 | 5.0 | 15.0 | 30.0 | 30.0 | 50.0 |
| 37 | 19 | nr | 5.0 | 5.0 | 5.0 | 20.0 | 40.0 | 50.0 | ND |
| 38 | | nr | 5.0 | 5.0 | 5.0 | 20.0 | 40.0 | 50.0 | ND |
| 39 | 20 | nr | 5.0 | 5.0 | 5.0 | 10.0 | 40.0 | 50.0 | ND |
| 40 | | nr | 5.0 | 5.0 | 5.0 | 10.0 | 40.0 | 50.0 | ND |
| 49 | 25 | nr | 5.0 | 10.0 | 10.0 | 20.0 | 20.0 | 30.0 | 50.0 |
| 50 | | nr | 5.0 | 10.0 | 10.0 | 20.0 | 20.0 | 30.0 | 50.0 |
| 51 | 26 | nr | 1.0 | 1.0 | 5.0 | 10.0 | 20.0 | 30.0 | 50.0 |
| 52 | | nr | 1.0 | 1.0 | 5.0 | 10.0 | 20.0 | 30.0 | 50.0 |
| 53 | 27 | nr | 1.0 | 5.0 | 5.0 | 10.0 | 30.0 | 50.0 | ND |
| 54 | | nr | 1.0 | 5.0 | 5.0 | 10.0 | 30.0 | 50.0 | ND |
| 55 | 28 | nr | 1.0 | 10.0 | 10.0 | 10.0 | 30.0 | 30.0 | 50.0 |
| 56 | | nr | 1.0 | 10.0 | 10.0 | 10.0 | 30.0 | 30.0 | 50.0 |
| 73 | 37 | nr | 1.0 | 1.0 | 5.0 | 15.0 | 20.0 | 30.0 | 50.0 |
| 74 | | nr | 1.0 | 1.0 | 5.0 | 15.0 | 20.0 | 30.0 | 50.0 |
| 75 | 38 | nr | 1.0 | 5.0 | 10.0 | 15.0 | 30.0 | 50.0 | ND |
| 76 | | nr | 1.0 | 5.0 | 10.0 | 15.0 | 30.0 | 50.0 | ND |
| 77 | 39 | nr | 1.0 | 5.0 | 10.0 | 15.0 | 50.0 | ND | ND |
| 78 | | nr | 1.0 | 5.0 | 10.0 | 15.0 | 50.0 | ND | ND |
| 79 | 40 | nr | 1.0 | 5.0 | 10.0 | 15.0 | 30.0 | 40.0 | 50.0 |
| 80 | | nr | 1.0 | 5.0 | 10.0 | 15.0 | 30.0 | 40.0 | 50.0 |

A significant improvement in zinc dissolution rate into the baths was found when Organic Acid Inhibitors according to the invention were used in the bath without significant effect on corrosion performance. Glycolic acid and $H_2SiF_6$ both increase corrosion resistance while retaining low resistivity. A surprising result was that a small amount of Zn in the bath made improvement to salt spray resistance, which was not predicted based on prior understanding of increasing Zn levels in working baths causing reduction in coating quality. Consistently good resistivity and corrosion resistance are seen when both $H_2SiF_6$ and glycolic acid are employed. Now a cobalt and nitrate free passivate, with fluoride level low enough to prevent attack on stainless steel alloys can outperform commercial products while substantially avoiding these hazards.

Example 9

Ex. 248A (similar to Ex. 229A concentrate, optimized method): 1600 g DI water, 1.16 g ZnO powder, 720.0 g 75% $H_3PO_4$ (5.51 moles), 76.4 g 48% rgt HF (1.82 moles) note: ZnO now dissolved, 561.6 g 25% $H_2SiF_6$ (0.974 moles), 360 g $CrO_3$ (3.6 moles), 124.0 g 70% sorbitol, post heat 80 C/3 hrs=<1 ppm Cr+6. Total weight adjusted to 3566 g=5.25% as Cr. Reactor very clean.

New formulations were prepared as follows:

Ex. 267A: 952.9 g Ex. 248A, 40.0 g glycolic acid, 4.1 g deionized water, 3.0 g OAI 1, mix and allow to age for 24 hrs.

Ex 267B: 180.0 g Ex 267A, 3.5 g polyoxyethylene (12) cocoamine CAS 77-92-9

Ex 267C: 180.0 g Ex 267A, 7.2 g hydrolyzed collagen CAS 68410-45-7

Ex. 268A (like Ex 267A, but left out glycolic acid): 952.9 g Ex. 248A, 4.1 g deionized water, 3.0 g OAI 1, mix and allow to age for 24 hrs Ex. 268B: 172.8 g Ex 268A, 7.2 g citric acid anhydrous Ex. 268C: 172.8 g Ex 268A, 7.2 g oxalic acid dihydrate Ex. 268D: 172.8 g Ex 268A, 7.2 g D-tartaric acid Ex. 268E: 172.8 g Ex 268A, 7.2 g succinic acid (not all dissolves)

Ex. 268F: 172.8 g Ex 268A, 7.2 g maleic acid

Ex. 268G: 172.8 g Ex 268A, 7.2 g malonic acid

Ex. 268H: 172.8 g Ex 268A, 7.2 g DL-malic acid

Ex. 268I: 172.8 g Ex 268A, 7.2 g 40% phytic acid

Ex. 268J: 172.8 g Ex 268A, 7.2 g sulfamic acid

The procedure for coating from example 7 (with roller-coater) was repeated with fresh panels using the formulations recited above. The results of testing are shown in Table I, J and K and L.

TABLE I

| | | Wt % | Coating Weight[1] | Gloss[2] |
|---|---|---|---|---|
| 1 | Ex. 267A | 30 | 3.43 | 198 |
| 2 | Ex. 267A | 25 | 2.76 | 200 |
| 3 | Ex. 267A | 20 | 2.17 | 180 |
| 4 | Ex. 267B | " | 4.16 | 106 |
| 5 | Ex. 267C | " | 2.84 | 112 |
| 6 | Ex. 268B | " | 2.14 | 168 |
| 7 | Ex. 268C | 20 | 2.17 | 182 |
| 8 | Ex. 268D | " | 2.11 | 188 |
| 9 | Ex. 268E | " | 2.16 | 180 |
| 10 | Ex. 268F | " | 2.29 | 116 |
| 11 | Ex. 268G | 20 | 2.09 | 184 |
| 12 | Ex. 268H | " | 2.50 | 173 |
| 13 | Ex. 268I | " | 2.20 | 137 |
| 14 | Ex. 268J | " | 2.07 | 130 |
| 15 | Ex. 216E (Comparative Ex. 4): | 25 | 3.61 | 188 |

[1]used factor = 1000 counts/mg,
[2]clean only gloss = ND (~200)

TABLE J

| | Neutral Salt Spray Exposure Time (hr) | | | |
|---|---|---|---|---|
| Panel | 24 | 48 | 96 | 168 |
| | % corrosion of panels | | | |
| 1 | 2.0 | 5.0 | 15.0 | 25.0 |
| 2 | 1.0 | 5.0 | 15.0 | 20.0 |
| 3 | 0.0 | 0.0 | 5.0 | 20.0 |
| 4 | 0.0 | 0.0 | 1.0 | 1.0 |
| 5 | 0.0 | 0.0 | 1.0 | 5.0 |

TABLE J-continued

| | Neutral Salt Spray Exposure Time (hr) | | | |
|---|---|---|---|---|
| Panel | 24 | 48 | 96 | 168 |
| | % corrosion of panels | | | |
| 6 | 15.0 | 30.0 | ND | ND |
| 7 | 10.0 | 20.0 | ND | ND |
| 8 | 2.0 | 10.0 | 25.0 | 35.0 |
| 9 | 10.0 | 30.0 | ND | ND |
| 10 | 5.0 | 15.0 | 30.0 | 40.0 |
| 11 | 5.0 | 10.0 | 25.0 | 40.0 |
| 12 | 1.0 | 5.0 | 10.0 | 15.0 |
| 13 | 5.0 | 20.0 | 2.0 | 90.0 |
| 14 | 20.0 | 50.0 | ND | ND |
| 15 | 30.0 | 60.0 | ND | ND |

TABLE K

| | Coat from | Stack Test Exposure Time (hr) | | | | | |
|---|---|---|---|---|---|---|---|
| Panel | Table H | 168 | 336 | 504 | 672 | 840 | 1008 |
| 1 | 1 | nr | 0.0 | 0.0 | 1.0 | 1.0 | 30.0 |
| 2 | | nr | 0.0 | 0.0 | 1.0 | 1.0 | 30.0 |
| 3 | 2 | nr | 1.0 | 1.0 | 1.0 | 10.0 | 40.0 |
| 4 | | nr | 1.0 | 1.0 | 1.0 | 10.0 | 40.0 |
| 5 | 3 | nr | 0.0 | 0.0 | 1.0 | 5.0 | 50.0 |
| 6 | | nr | 0.0 | 0.0 | 1.0 | 5.0 | 50.0 |
| 7 | 4 | nr | 0.0 | 0.0 | 0.0 | 0.1 | 50.0 |
| 8 | | nr | 0.0 | 0.0 | 0.0 | 0.1 | 50.0 |
| 9 | 5 | nr | 0.0 | 0.0 | 5.0 | 5.0 | 40.0 |
| 10 | | nr | 0.0 | 0.0 | 5.0 | 5.0 | 40.0 |
| 11 | 6 | nr | 0.0 | 0.0 | 0.0 | 10.0 | 50.0 |
| 12 | | nr | 0.0 | 0.0 | 0.0 | 10.0 | 50.0 |
| 13 | 7 | nr | 0.0 | 0.0 | 0.0 | 10.0 | 50.0 |
| 14 | | nr | 0.0 | 0.0 | 0.0 | 10.0 | 50.0 |
| 15 | 8 | nr | 0.0 | 0.0 | 1.0 | 10.0 | 50.0 |
| 16 | | nr | 0.0 | 0.0 | 1.0 | 10.0 | 50.0 |
| 17 | 9 | nr | 0.0 | 0.0 | 1.0 | 10.0 | 50.0 |
| 18 | | nr | 0.0 | 0.0 | 1.0 | 10.0 | 50.0 |
| 19 | 10 | nr | 0.0 | 0.0 | 1.0 | 5.0 | 30.0 |
| 20 | | nr | 0.0 | 0.0 | 1.0 | 5.0 | 30.0 |
| 21 | 11 | nr | 0.0 | 0.0 | 10.0 | 10.0 | 50.0 |
| 22 | | nr | 0.0 | 0.0 | 10.0 | 10.0 | 50.0 |
| 23 | 12 | nr | 0.0 | 0.0 | 1.0 | 15.0 | 100.0 |
| 24 | | nr | 0.0 | 0.0 | 1.0 | 15.0 | 100.0 |
| 25 | 13 | nr | 0.0 | 0.0 | 1.0 | 15.0 | 100.0 |
| 26 | | nr | 0.0 | 0.0 | 1.0 | 15.0 | 100.0 |
| 27 | 14 | nr | 0.0 | 0.0 | 1.0 | 10.0 | 100.0 |
| 28 | | nr | 0.0 | 0.0 | 1.0 | 10.0 | 100.0 |
| 29* | 15 | nr | 30.0 | 30.0 | 50.0 | ND | ND |
| 30* | | nr | 30.0 | 30.0 | 50.0 | ND | ND |

*Odd data based on prior results. Ex. 216E usually does very good in stack.

TABLE Ib

| | | Wt % | Coating Weight[1] | Gloss[2] | Resistivity <1 mohm[3] |
|---|---|---|---|---|---|
| 1 | Ex. 267A | 20 | 2.36 | 173 | 4 |
| 2 | Ex. 216E (Comparative Ex. 4): | 25 | 3.71 | 204 | 7 |

[1]used factor = 1000 counts/mg,
[2]clean only gloss = 309,
[3]out of 8 tests

TABLE Jb

| Panel | Neutral Salt Spray Exposure Time (hr) 24 | 48 | 72 | 96 | 168 |
|---|---|---|---|---|---|
| | % corrosion of panels | | | | |
| 1 | 0.0 | 1.0 | 5.0 | 10.0 | 30.0 |
| 2 | 15.0 | 30.0 | 80.0 | ND | ND |

TABLE Kb

| Panel | Coat from Table H | Stack Test Exposure Time (hr) 168 | 336 | 504 | 672 | 840 | 1008 |
|---|---|---|---|---|---|---|---|
| 1 | 1 | 0.0 | 10.0 | 10.0 | 40.0 | 50.0 | ND |
| 2 | | 0.0 | 10.0 | 10.0 | 40.0 | 50.0 | ND |
| 3 | 2 | 0.0 | 1.0 | 2.0 | 5.0 | 10.0 | 20.0 |
| 4 | | 0.0 | 1.0 | 2.0 | 5.0 | 10.0 | 20.0 |

TABLE L

| Panel | Cleveland Test (hr) 168 | 336 | 504 | 840 | 1008 |
|---|---|---|---|---|---|
| | % corrosion of panels | | | | |
| 1 | 0.1 | 0.1 | 2.0 | 5.0 | 5.0 |
| 2 | 0.1 | 0.1 | 1.0 | 1.0 | 1.0 |

Example 10

Cut Galvalume™ substrate into 4×12×0.024" sections. These were then spray cleaned in 150° F. (non-etching) 4% Ridoline 321 for 45 seconds, 15 sec HWR, squeegee and blow dried. Because some panels showed partial dewetting, each panel was given a wipe with IPA and dried using separate clean wiper surfaces for each panel. The procedure for coating from example 7 (with roller-coater) was repeated with Galvalume™ panels using two of the formulations recited above. The results of testing of these coated panels are shown in Tables M, N, O, and P.

TABLE M

| | | Wt % | Coating Weight[1] | Gloss[2] | Resistivity <1 mohm[3] |
|---|---|---|---|---|---|
| 1 | Ex. 267A | 20 | 1.83 | 83 | 8 |
| 2 | Ex. 267A | 20 | 1.93 | ND | 8 |
| 3 | Ex. 216E (Comparative Ex. 4): | 25 | 3.85 | 82 | 8 |
| 4 | Ex. 216E (Comparative Ex. 4): | 25 | 3.90 | ND | 8 |

[1]used factor = 1000 counts/mg,
[2]clean only gloss = 84,
[3]out of 8 tests

TABLE N

| Panel | Neutral Salt Spray Exposure Time (hr) 24 | 48 | 96 | 168 |
|---|---|---|---|---|
| | % corrosion of panels | | | |
| 1 | 0.0 | 0.0 | 1.0 | 1.0 |
| 2 | 1.0 | 1.0 | 1.0 | 1.0 |

TABLE N-continued

| Panel | Neutral Salt Spray Exposure Time (hr) 24 | 48 | 96 | 168 |
|---|---|---|---|---|
| | % corrosion of panels | | | |
| 3 | 0.0 | 0.0 | 0.1 | 5.0 |
| 4 | 0.0 | 0.0 | 0.1 | 1.0 |

TABLE O

| Panel | Coat from Table H | Stack Test Exposure Time (hr) 168 | 336 | 504 | 672 | 840 | 1008 |
|---|---|---|---|---|---|---|---|
| 1 | 1 | 0.0 | 0.0 | 60.0 | ND | ND | ND |
| 2 | | 0.0 | 0.0 | 60.0 | ND | ND | ND |
| 3 | 2 | 0.0 | 40.0 | 80.0 | ND | ND | ND |
| 4 | | 0.0 | 40.0 | 80.0 | ND | ND | ND |
| 3 | 3 | 90.0 | ND | ND | ND | ND | ND |
| 5 | | 90.0 | ND | ND | ND | ND | ND |
| 6 | 4 | 90.0 | ND | ND | ND | ND | ND |
| 7 | | 90.0 | ND | ND | ND | ND | ND |

TABLE P

| Panel | Cleveland Test (hr) 168 | 336 | 504 | 840 | 1008 |
|---|---|---|---|---|---|
| | % corrosion of panels | | | | |
| 1 | 0.0 | 0.0 | 0.0 | 0.1 | 5.0 |
| 2 | 0.0 | 0.0 | 0.0 | 0.1 | 2.0 |
| 3 | 2.0 | 15.0 | 30.0 | ND | ND |
| 4 | 10.0 | 40.0 | 80.0 | ND | ND |

Results show an easy to manufacture and cost effective Cr+3 composition comprising a combination of phosphate, $H_2SiF_6$, HF at levels to inhibit stainless steel attack (304/316 alloy tested), hydroxycarboxylic acid, and an organic zinc dissolution inhibitor.

In certain embodiments, the optimized use rate (Cr coating weight) appears to be 30-40% less than currently available products. In certain embodiments, in addition to glycolic acid, DL-malic acid appears to provide beneficial effects. DL-malic acid can also help to eliminate VOC content that may be detected as a result of glycolic acid in the formula. In certain embodiments, the addition of an ethoxylated fatty amine or polypeptides in the form of hydrolyzed collagen can result in significant salt-spray and stack performance increase. In certain embodiments, an anti-foaming agent, such as Surfynol® DF-70, may be provided.

It has been found that in at least certain embodiments, the use of inhibitors with the compositions help to maintain the coating composition as much as possible along the entire length of the metal coil (same zinc level from the first foot to the last) and any additional coil(s). It is believed that a small amount of an effective inhibitor can prevent up to 99+% of the zinc build-up seen normally without inhibitor.

In at least certain embodiments, such as example 10, the composition has demonstrated improved performance on Galvalume™ compared to a commercial nitrate containing passivate, even in stack and soak testing. It is believed that avoiding a nitrate containing formula can allow safe, low-cost manufacturing since all of the Cr+3 content can be derived from a reduction of chromic acid, rather than prepared $Cr(NO)_3$ solution. Nitrate in the formula can also react with residual or added organics, later producing NO gas.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A passivation composition for treating a metal substrate, the passivation composition comprising water and the following components:

dissolved phosphate ions;

dissolved trivalent chromium ions;

dissolved fluorometallate ions; and an organic acid inhibitor comprising a quaternized ammonium compound, wherein the composition contains less than 0.04 percent by weight of nitrates or peroxides, is substantially hexavalent chromium-free and further includes hydroxyorganic acid.

2. The passivation composition of claim 1, wherein the weight ratio of phosphate ion to trivalent chromium ion ranges from 0.10:1.0 to 7.5:1.0.

3. The passivation composition of claim 1, wherein the weight ratio of phosphate ion to trivalent chromium ion ranges from 0.650:1.0 to 2.5:1.0.

4. The passivation composition of claim 1, wherein the quaternized ammonium compound comprises at least one of a nitrogen atom-containing ring having a quantity of ring-carbon atoms ranging from 5 to 14.

5. The passivation composition of claim 4, wherein the nitrogen atom-containing ring includes an aryl quinolinium halide or hydroxide.

6. The passivation composition of claim 1, further comprising dissolved free fluoride ions and:

at least one first additive selected from a group consisting of a dissolved inorganic metal compound, an organic composition capable of reducing a hexavalent chromium ion, when present before blending the mixture, to a trivalent chromium ion, and a pH adjusting composition.

7. The passivation composition of claim 6, further comprising:

at least one second additive selected from a group consisting of a sequestrant, a wetting agent, a defoamer, and fluoride ions.

8. The passivation composition of claim 6, further comprising:

at least one second additive selected from a group consisting of a sequestrant, a wetting agent, a defoamer, and fluoride ions.

9. The passivation composition of claim 8, wherein the inhibitor comprises a quaternized ammonium compound having a quantity ranging from 0.001 g/L to 2 g/L in the composition.

10. The passivation composition of claim 1, wherein:

the trivalent chromium ion is present in the composition in a range of 1 g/L to 75 g/L;

the phosphate ion is present in the composition in a range of 2 g/L to 400 g/L;

the fluorometallate ion is present in the composition in a range of 0.5 g/L to 60 g/L; and the composition has a pH of 0.5 to 5.0.

11. The passivation composition of claim 10, wherein the inhibitor comprises a quaternized ammonium compound having a quantity ranging from 0.001 g/L to 2 g/L in the composition.

12. The passivation composition of claim 1 wherein the phosphate ions and the trivalent chromium ions are provided as separate sources.

13. The passivation composition of claim 1 wherein the composition is essentially free of nitrates and peroxides.

14. The passivation composition of claim 1, wherein:

the trivalent chromium ion is present in the composition in a range of 17 g/L to 20 g/L;

the phosphate ion is present in the composition in a range of 17 g/L to 34 g/L; and the fluorometallate ion is present in the composition in a range of 13 g/L to 23 g/L.

15. The passivation composition of claim 14, wherein the quaternized ammonium compound has a quantity ranging from 0.10 g/L to 0.15 g/L in the composition.

16. The passivation composition of claim 15, wherein the quaternized ammonium compound comprises a quinolinium halide and wherein the weight ratio of phosphate ion to trivalent chromium ions ranges from 0.9:1 to 1.5:1.

17. The passivation composition of claim 1, wherein the quaternized ammonium compound comprises an aromatic quaternary ammonium.

18. The passivation composition of claim 17, wherein the aromatic quarternized ammonium comprises an aryl substituted quinolinium halide.

19. The passivation composition of claim 18, wherein the aryl substituted quinolinium halide comprises 1-benzylquinolinium.

20. A passivation composition for treating a metal substrate, the passivation composition comprising water and the following components:

dissolved phosphate ions;

dissolved trivalent chromium ions;

dissolved fluorometallate ions; and an organic acid inhibitor comprising a quaternized ammonium compound, wherein the composition contains less than 0.04 percent by weight of nitrates or peroxides, wherein the quaternized ammonium compound comprises at least one of a nitrogen atom-containing ring having a quantity of ring-carbon atoms ranging from 5 to 14.

21. The passivation composition of claim 20, further comprising dissolved free fluoride ions and:

at least one first additive selected from a group consisting of a dissolved inorganic metal compound, an organic composition capable of reducing a hexavalent chromium ion, when present before blending the mixture, to a trivalent chromium ion, and a pH adjusting composition.

22. The passivation composition of claim 21, further comprising:

at least one second additive selected from a group consisting of a sequestrant, a wetting agent, a defoamer, and fluoride ions.

23. The passivation composition of claim 22, wherein the inhibitor comprises a quaternized ammonium compound having a quantity ranging from 0.001 g/L to 2 g/L in the composition.

24. The passivation composition of claim 20, wherein the nitrogen atom-containing ring includes an aryl quinolinium halide or hydroxide.

25. A passivation composition for treating a metal substrate, the passivation composition comprising water and the following components:

dissolved phosphate ions;

dissolved trivalent chromium ions;

dissolved fluorometallate ions; and an organic acid inhibitor comprising a quaternized ammonium compound, wherein the composition contains less than 0.04 percent by weight of nitrates or peroxides, wherein the quaternized ammonium compound comprises an aromatic quaternary ammonium.

26. The passivation composition of claim 25, further comprising dissolved free fluoride ions and:

at least one first additive selected from a group consisting of a dissolved inorganic metal compound, an organic composition capable of reducing a hexavalent chromium ion, when present before blending the mixture, to a trivalent chromium ion, and a pH adjusting composition.

27. The passivation composition of claim 25, wherein the aromatic quarternized ammonium comprises an aryl substituted quinolinium halide.

28. The passivation composition of claim 27, wherein the aryl substituted quinolinium halide comprises 1-benzylquinolinium.

* * * * *